United States Patent [19]

Söhner et al.

[11] 4,167,170

[45] Sep. 11, 1979

[54] TURN-OFF PROTECTED IGNITION SYSTEM FOR INTERNAL COMBUSTION ENGINES

[75] Inventors: Gerhard Söhner, Remshalden; Helmut Roth, Schwieberdingon, both of Fed. Rep. of Germany

[73] Assignee: Robert Bosch GmbH, Stuttgart, Fed. Rep. of Germany

[21] Appl. No.: 855,937

[22] Filed: Nov. 30, 1977

[30] Foreign Application Priority Data

Dec. 1, 1976 [DE] Fed. Rep. of Germany ..... 2654413

[51] Int. Cl.[2] ..... F02B 1/02

[52] U.S. Cl. ..... 123/148 E; 123/148 S; 123/117 R

[58] Field of Search ..... 123/148 E, 146 JS, 148 S, 123/117 R, 32 EA

[56] References Cited

U.S. PATENT DOCUMENTS

| | | | |
|---|---|---|---|
| 3,745,985 | 7/1973 | Höhne | 123/146 JD |
| 3,874,355 | 4/1975 | Suda et al. | 123/148 E |
| 3,881,458 | 5/1975 | Roozenbook | 123/148 E |
| 3,884,208 | 8/1975 | Beuter | 123/148 E |
| 3,924,595 | 12/1975 | Brungsberg | 123/148 E |
| 4,051,827 | 10/1977 | Capurka et al. | 123/148 E |
| 4,074,665 | 2/1978 | Patis | 123/148 E |
| 4,077,377 | 3/1978 | Jundt et al. | 123/148 S |

*Primary Examiner*—Charles J. Myhre
*Assistant Examiner*—R. A. Nelli
*Attorney, Agent, or Firm*—Frishauf, Holtz, Goodman & Woodward

[57] ABSTRACT

A transistorized ignition system is protected against interruption of power supply by, for example, turn-off of the main or ignition switch while the transistor is in conductive condition so that, upon sudden interruption, an ignition event could be triggered at a time unsuitable for the remainder of the engine. A turn-off protection circuit is provided which includes a coupling resistor connected to the junction of the primary of the ignition coil and the main ignition current supply transistor thereto. The coupling resistor is connected in a circuit which holds the main current supply transistor in conductive condition, supplied from the energy stored in the ignition coil even after the main, ignition switch has been opened. A closed circuit for current flow due to this stored energy is provided within the overall ignition circuit. Preferably, the system includes a coupling transistor, connected across the power supply, which is blocked when the main transistor is conductive, so that the main transistor is controlled by power supply voltage appearing at the collector of the coupling transistor; the coupling resistor of the turn-off protected circuit then applies the inductive voltage from the coil to the collector terminal of the coupling transistor, and hence simulates continued power supply to the main current supply transistor to continue to hold it conductive and thus prevent abrupt turn-off and initiation of an undesired ignition event.

10 Claims, 1 Drawing Figure

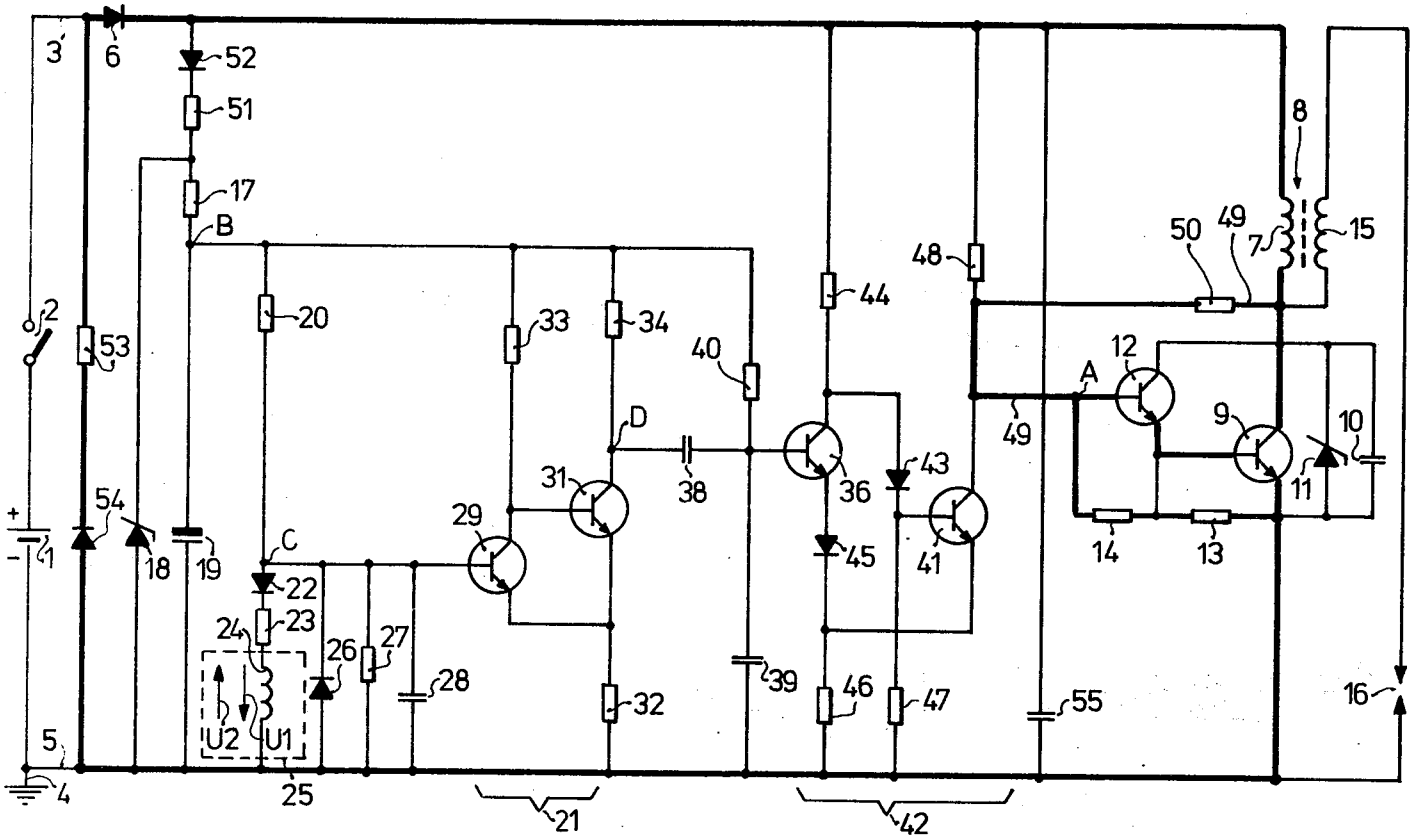
1
2
3
4
5
6
7
8
9
10
11
12
13
14
15
16
17
18
19
20
21
22
23
24
25
26
27
28
29
31
32
33
34
36
38
39
40
41
42
43
44
45
46
47
48
49
50
51
52
53
54
55
A
B
C
D
U1
U2

TURN-OFF PROTECTED IGNITION SYSTEM FOR INTERNAL COMBUSTION ENGINES

CROSS REFERENCE TO RELATED PATENT*

U. S. Pat. No. 3,881,458.

The present invention relates to a transistorized ignition system, and more particularly to a transistorized ignition system in which a main ignition current supply transistor is serially connected with an ignition coil, the transistor being controlled to abrupt blocking condition to initiate an ignition event.

BACKGROUND AND PRIOR ART.

U. S. Pat. No. 3,881,458 Roozenbeek et al assigned to the assignee of this application, is directed to an ignition system in which a main current supply transistor is connected in series with the ignition coil to control current flow therethrough. A stabilized voltage circuit, including a Zener diode, is provided, connected to the source of power for the transistorized ignition circuit, typically an automotive battery. A pulse source provides pulses to command ignition events; this may be a breaker-controlled pulse source, or an inductively or otherwise controlled pulse source. A controlled transistor is connected to the pulse source and, in turn, controls through an intermediate coupling transistor the main ignition current supply transistor. The intermediate coupling transistor is so arranged that, when the main current supply transistor is conductive, it itself is blocked, so that effectively full battery or operating voltage can be applied to the control terminal of the main ignition current supply transistor when it is conductive.

It has been observed that occasionally the main operating or ignition switch of the motor vehicle may be broken just at the time when the main power supply transistor is conductive and while a piston of the engine is in a position which, should an explosion occur, might damage the engine, or components thereof. If, at this moment, the ignition switch is turned off, the main power supply transistor will block, triggering an ignition event which may cause this damage.

THE INVENTION.

It is an object of the invention to provide a turn-off protection circuit which prevents damage to the engine if, by chance, the main power supply to the ignition system is interrupted at an inopportune moment with respect to the engine - ignition system operating characteristics.

Briefly, a turn-off protection circuit is combined with the transistorized ignition circuit which, basically, is similar to that of the aforementioned U.S. Pat. No. 3,881,458, and which includes a coupling resistor connected to the junction between the primary of the ignition coil and the main current supply transistor to provide a control voltage to the main current supply transistor to hold it in conductive condition even after the main power supply is disconnected. This control voltage is derived from the energy stored in the coil itself. Additional circuit elements, such as a diode-resistor path, are provided to establish a closed circuit for current flow due to the stored energy in the coil, independent from the main switch.

The turn-off protection circuit prevents generation of an ignition event, and hence of an ignition spark if the emitter-collector path of the power supply transistor is conductive and, at the same time, the main ignition switch is opened, by continuing to hold the main power supply transistor in conductive condition to prevent abrupt turn-off. The circuit, additionally, is essentially immune to stray noise pulses.

DRAWING, — illustrating an example:

The single FIGURE is a schematic circuit diagram of the ignition system with the turn-off protection circuit in accordance with the present invention. This circuit is shown in broadened line.

The ignition system is to be used with an internal combustion engine (not shown), typically for an automotive vehicle. The ignition system is supplied from a power source 1, typically the battery of the vehicle. The power source 1 is connected to the ignition system through a main or ignition switch 2, to then supply a positive supply bus 3. The other terminal of the battery 1 is connected to a reference potential or ground or chassis of the motor vehicle as indicated at 4, and additionally to a negative or reference supply bus 5.

The ignition system is connected to bus 3 through diode 6 which operates as a reverse polarity protection diode, to protect the system against inadvertent erroneously poled connection of battery 1. Diode 6 is then connected to the primary 7 of an ignition coil 8, the other terminal of which is connected to the collector of the main ignition current supply control transistor 9, the emitter of which is connected to chassis bus 5. Transistor 9, actually, is a composite formed of transistors 9 and 12, connected in the well-known Darlington circuit. A capacitor 10 and a Zener diode 11 are connected in parallel to the emitter-collector path of transistor 9 for its protection. The main transistor 9 has its emitter connected to the emitter of the transistor 12 through a resistor 13, the emitter of transistor 12 being additionally connected to the base of transistor 9, and further to a resistor 14 which, in turn, is connected to the base of transistor 12. The base of transistor 12 and the connection to the resistor 14 form a first junction A.

The secondary 15 of ignition coil 8 is connected to the junction between the primary 7 and the collector of emitter 9 and further to spark plug 16, for example for multi-cylinder engines, through a distributor (not shown).

The portion of the main supply bus beyond diode 6 forms a connection to a supply line for a source of stabilized voltage supply, including a coupling resistor 17 which connects to a second junction B. The second junction B is likewise connected through resistor 17 to the cathode of a Zener diode 18, the anode of which is connected to ground or chassis. A capacitor 19 is connected between junction B and chassis 5. Capacitor capacitor 19 is protected against overvoltages, as will appear, and thus can be made as a dry electrolytic capacitor, for example a tantalum capacitor. Junction B is connected through a resistor 20 to a further junction C which forms the input terminal to a threshold circuit 21. The threshold circuit 21 senses threshold levels from a pulse transducer 25 which, as schematically shown, is a winding 24 located in magnetically coupled relationship to permanent magnets located on a rotating element, rotating with rotation of the internal combustion engine, and providing output pulses in the form of a-c voltages U1, U2. During operation, the transducer 25 provides an approximately sinusoidal alternating current. Coil 24 of transducer 25 is coupled to junction C through a diode 22 and a coupling resistor 23. Diode 22 is poled in conductive direction with respect to battery 1. Junction C is additionally connected to a network including diode 26, poled in blocking direction with respect to the battery 1, a parallel connected resistor 27, and a capacitor 28 which bypasses noise pulses. Junction C additionally forms the input to a threshold switch 21, formed by transistor 29, 31. Thus, junction C is connected to the base of npn input transistor 29, the collector of which is coupled to the base of output transistor 31. The transistors 29/31 operate in form of a Schmitt trigger. The transistors 29, 31 have their emitters connected through a common emitter resistor 32 to chassis bus 5. The collector of the input transistor 29 is supplied with operating voltage through a resistor 33 and connected to stabilized terminal B. The collector of output transistor 31 is supplied with stabilized voltage through collector resistor 34. The output from the threshold circuit is derived from junction D and is connected to the base of an npn control transistor 36 through a coupling capacitor 38. Capacitor 39 is a bypass for noise pulses; resistor 40 supplies bias voltage to the base of transistor 36. Control transistor 36 is connected to an npn coupling transistor 41, transistors 36/41 operating also in form of a Schmitt trigger threshold circuit 42. Control transistor 36 has its collector connected through resistor 44 to the unregulated power supply, and further through a diode 43 to the base of coupling transistor 41. The emitter of the control transistor 36 is connected to the anode of a diode 45 and then, together with the emitter of transistor 41, through a common emitter resistor 46 to reference bus 5. The coupling transistor 41 has its base additionally connected to the reference bus 5 through a base resistor 47. The collector of transistor 41 is connected through resistor 48 to the main unregulated power supply 3 through diode. Thus, when transistor 41 is in blocked condition, its collector has, effectively, battery voltage appear thereon.

In accordance with the present invention, a turn-off protection circuit 49 is provided which is a branch, starting from the collector of the main ignition current supply transistor 9 through a comparatively high resistance resistor 50 to the collector of coupling transistor 41. It then continues to junction point A. A return current path is provided through resistor 53 and diode 54 connected between bus 5 and bus 3 and through the reverse polarization diode 6. The branch which includes the coupling resistor 17, connected to Zener diode 18, is additionally connected through a coupling resistor 51 and diode 52, poled in current-passing direction to the bus 3, behind diode 6. The Zener diode 18 is connected to the junction between the two resistors 17, 51. An additional charge holding capacitor 55 is connected between line 3, behind diode 6, and reference bus 5.

General operation of the system:

The system is placed in operation upon closing of switch 2. If winding 24 of the pulse source 25 provides a positive voltage half-wave, that is, a half-wave indicated by the arrow U2, no change of voltage will become effective on the base of the input transistor 29 of the threshold switch 21 due to the presence of diodes 22, 26. Control current will be supplied through the base-emitter path of input transistor 29 which provides a closed circuit through the circuit elements: 2-6-52-51-17-20-32. Consequently, transistor 29 will be conductive which will clamp transistor 31 to blocked condition. Consequently, the base-emitter circuit of control transistor 36 will be controlled to be conductive through the circuit: 2, 6, 52, 51, 17, 40, 45, 46. A portion of the current will also flow over resistor 34 to charge capacitor 38 so that capacitor 38 will accept a certain energy charge.

The base-emitter path of the coupling transistor 41 is shorted by the conductive emitter-collector path of control transistor 36, thus blocking the transistor 41. Consequently, current will flow through a main control path as follows: 2, 6, 48, 14, 13, to provide voltage drops across resistors 14 and 13 so that the emitter-collector paths of the Darlington transistors 9, 12 control these transistors to become conductive. Primary 7 of ignition coil 8 is thus supplied with current from battery 1.

When the voltage of the tranducer 25 reverses, so that a negative voltage will become effective, see arrow U1, the diode 26 and resistor 27 will have current flowing therethrough which is fed back through diode 22 and resistor 23 to the transducer winding 24 preventing current from being applied to the base of input transistor 29. Control current will then flow in the base-emitter path of the output transistor 31 as follows: 2, 6, 52, 51, 17, 33, 32, rendering the transistor 31 conductive. This changes the charge state on the control capacitor 38 through transistor 31 and resistor 32 and capacitor 39. The voltage at the base of the control transistor 36 becomes so negative that its emitter-collector path quickly becomes non-conductive. The galvanic coupling between the control transistor 36 and the coupling transistor 41 will control coupling transistor 41 to be rapidly and suddenly conductive, and additionally due to the feedback circuit which is increasingly effective at its base-emitter path, through circuit components: 2, 6, 44, 43, 46. The voltage drops at the shunting resistors 13, 14, and thus at the emitter-collector path of the Darlington transistor 12 and hence at the final transistor 9 rapidly drop out, so that the main ignition current supply transistor 9 will block abruptly. The interruption of the current through the primary 7 results in a high-voltage pulse in the secondary 15 of ignition coil 8 so that an ignition event is triggered at spark plug 16.

The capacitor 38 will continue to discharge. As the discharge proceeds, the voltage at the base of the transistor 36 will continue to increase, thus again controlling the transistor 36 to conductive state. consequently, the emitter-collector path of the coupling transistor 41 will then again become non-conductive, which will control the Darlington pair 9/12 into conductive state. Current through the primary 7 of ignition coil 8, and hence storage of energy can resume, even before the negative voltage half-wave U1 from the signal source 24 has terminated, that is, before threshold switch 21 has changed over or before the emitter collector path of its input transistor 29 has become conductive, and the output path of the transistor 31 has blocked. Control capacitor 38 thus is recharged again over circuit elements 2, 6, 52, 51, 17, 34, 36, 45, 46 so that control energy is available for a subsequent ignition event.

Diode 45 connected between the emitter of control transistor 36 and resistor 46 protects the base-emitter path of transistor 36 against over-voltages if the control capacitor 38 discharges through the emitter-collector path of the output transistor 41. Diode 43 insures a predetermined switching voltage for the control transistor 36, as well for the coupling transistor 41, together forming the threshold switch 42, to provide a predetermined threshold level at which threshold switch 42 responds, and to additionally provide for compensation.

Operation of the protective circuit in accordance with the invention:

Let it be assumed that transistor 9 is conductive, and ignition energy is being stored in ignition coil 8. This condition requires that the coupling transistor 41 of threshold switch 42 is non-conductive or blocked. If, with this circuit condition, switch 2 is opened, primary 7 of ignition coil 8 also will have its current flow interrupted. The effect, as far as coil 8 is concerned, is the same as if transistor 9 has blocked. This interruption of primary current flow would lead to a high voltage pulse in the secondary 15, and hence to a spark plug arc, absent the protective circuit. Upon interruption of current flow in the primary 7, conductive current can flow over resistor 50 and the coupling resistors 13, 14, diode 54 and resistor 53, and diode 6, back to coil 8 so that the voltage drops which then occur at the emitter-collector path of the transistor 9 continue to control the transistor 9 to be conductive. Hence, no spark will occur at spark plug 16 since the secondary 15 will not have a sharp voltage pulse appear thereat. The discharge of the additional capacitor 55 enhances the above referred-to turn-off protection current flow so that the emitter-collector path of the final or main transistor 9 and hence of the second Darlington transistor 12 are reliably kept in conductive state. The additional resistor 51 and the connection of the Zener diode 18 to the junction point between the resistor 17 protects the capacitor 19 against over-voltages and simultaneously limits its charge current. The capacitor 19 thus can be a dry electrolytic capacitor, for example of the tantalum type. Such capacitors are inexpensive even with a relatively high capacity. A high capacity for capacitor 19 is necessary so that, even after the operating switch 2 has been opened, the second junction B will have a sufficiently high voltage appear thereat during the duration of the decay of the induction current flow in order to hold the emitter-collector path of the input transistor 29 and of the control transistor 36 in conductive condition and, additionally, the emitter-collector paths of the output transistors 31, 41 in blocked condition. If, however, the emitter-collector path of the coupling transistor 41, during current flow of the induction current, would become conductive, the emitter-collector paths of the main ignition current supply transistor 12 would likewise become non-conductive rapidly, breaking the closed circuit connection through the ignition coil and hence possibly permitting induction of a pulse in the secondary 15 which might still cause arc-over of spark plug 16. Diode 52 prevents discharge of the capacitor 19 through the circuit elements 44, 36, 45, 46 or 48, 14, 13, 12, 9, respectively.

Various changes and modifications may be made within the scope of the inventive concept.

In a typical installation for a 12V battery 1, resistor 50 had a value of: 2500 ohms
transistors 9, 12 were: Bosch-Darlington 46/74 b
resistors 13, 14 were: 500 ohms, 7500 ohms
resistor 53 had a value of: 3900 ohms
capacitor 19 had a value of: 6,8 μFarad
The nominal voltage at terminal B was: 6,8 volt

We claim:

1. Turn-off protected ignition system for internal combustion engine, having a source of electrical supply (1);

a main switch (2) connecting the source (1) to the ignition system, said system having an ignition coil (8);

a main ignition current supply transistor (9, 12) connected in series with said ignition coil (8) to control current flow therethrough;

a pulse source (25) providing pulses to command ignition events;

a control transistor (36) interconnecting the pulse source (25) and the main transistor (9, 12) to control conduction thereof in accordance with pulses applied to said control transistor (36);

a coupling transistor (41) connected between said control transistor (36) and said main transistor (9, 12), said coupling transistor being connected to be in blocked condition when said main transistor (9, 12) is conductive, and comprising, in accordance with the invention, a turn-off protection circuit (49) including a stabilized voltage circuit including a coupling element (51) connected to said source, a Zener diode (18) connected to the coupling element (51), and a stabilized-voltage current coupling element (17) connected to the junction of said coupling element (51) and the Zener diode (18) and providing a stabilized source (B) of current when connected to said electrical supply source (1), said control transistor being supplied from said stabilized voltage circuit;

a transistor coupling resistor (50) connected to the junction between the primary (7) of the ignition coil and the main transistor (9, 12) and further to the control electrode of the main transistor to supply operating voltage to the main transistor from energy stored in the coil (8) to hold the main transistor in conductive condition during decay of voltage in the coil upon interruption of said main switch if, at the moment of interruption, said main transistor was conductive;

energy storage means (19) connected to the stabilized-voltage current coupling element (17) to supply energy to the stabilized voltage circuit in the absence of power supplied from said source of electrical supply (1) to hold the coupling transistor (41) in blocked condition and prevent bypassing of the energy from said coil through said coupling transistor;

and means (6, 53, 54) establishing a closed circuit for current flow due to the stored energy in the coil (8) independent of said switch (2).

2. System according to claim 1, wherein the coupling transistor (41) has its collector connected to the base of the main transistor (9, 12).

3. System according to claim 1, further including a diode (52) connected in current conductive relationship with respect to said battery, battery (1), serially connected between said coupling resistor (51) and the connection to the battery (1).

4. System according to claim 1, further including a storage capacitor (55) connected across the ignition coil (8) and said main transistor to provide additional stored energy to the turn-off protection circuit and to continue to hold the main transistor conductive in the absence of power supplied from said source of electrical supply (1).

5. System according to claim 1, wherein the main ignition current supply transistor comprises a Darlington-connected transistor pair, the emitter-collector paths of which provide, when in conductive conductive condition, ignition current to the primary (7) of the ignition coils;

a first threshold switch (21, 22, 23, 29, 31) having its input connected to the pulse source (25);

a capacitor connecting the output of the threshold switch (21; 22, 23, 29, 31) to the input of the control transistor, the capacitor storing energy which decreases as the speed of operation of the engine increases;

the first threshold switch being supplied from said stabilized voltage circuit and thus supplying said capacitor (38).

6. System according to claim 1, wherein said main ignition current supply transistor (9, 12) comprises a pair of Darlington-connected transistors (9, 12);

and wherein said turn-off protection circuit (49) includes voltage dropping resistors (14, 13) connected between the bases and emitters, respectively, of the transistors (12, 9) of the Darlington pair and providing control power to said transistors derived from said transistor coupling element (50).

7. System according to claim 1, wherein the coupling resistor (50) interconnecting the junction of the primary (7) of the ignition coil and the control electrode of the main transistor (9, 12) is of sufficient resistance value to limit current flow to the main transistor (9, 12).

8. System according to claim 1, wherein said coupling elements (17, 50, 51) comprise resistors.

9. System according to claim 1, wherein said energy storage means comprises a capacitor (19) of the dry electrolytic type.

10. System according to claim 9, wherein said coupling elements (17, 50, 51) comprise resistors;

said main ignition current supply transistor (9, 12) comprises a pair of Darlington-connected transistors (9, 12);

and wherein said turn-off protection circuit (49) includes voltage dropping resistors (14, 13) connected between the bases and emitters, respectively, of the transistors (12, 9) of the Darlington pair and providing control power to said transistors derived from said transistor coupling element (50);

and further including a storage capacitor (55) connected across the ignition coil (8) and said main transistor (9, 12) to provide additional storaged energy to the turn-off protection circuit and to continue to hold the main transistor (9, 12) conductive in the absence of power supplied from said source of electrical supply (1).

* * * * *